United States Patent [19]

Dorer, Jr.

[11] 4,071,327

[45] Jan. 31, 1978

[54] SALTS OF MANNICH BASES AND DERIVATIVES THEREOF

[75] Inventor: Casper John Dorer, Jr., Lyndhurst, Ohio

[73] Assignee: The Lubrizol Corporation, Wickliffe, Ohio

[21] Appl. No.: 560,902

[22] Filed: Mar. 21, 1975

Related U.S. Application Data

[63] Continuation-in-part of Ser. No. 413,480, Nov. 7, 1973, abandoned.

[51] Int. Cl.[2] ..... C10L 1/22

[52] U.S. Cl. ..... 44/66; 252/393; 260/501.15; 260/501.17; 260/567.6 M; 44/71; 44/DIG. 1

[58] Field of Search ..... 44/66, 71, 73, DIG. 1, 44/74; 252/393; 260/567.6 M, 501.15, 501.17

[56] References Cited

U.S. PATENT DOCUMENTS

| | | | |
|---|---|---|---|
| 2,697,656 | 12/1954 | Stayner et al. | 260/501.13 |
| 2,759,975 | 8/1956 | Chiddix et al. | 260/567.6 M |
| 3,506,712 | 4/1970 | Capowski | 260/567.6 M |
| 3,877,889 | 4/1975 | Dix | 44/DIG. 1 |

*Primary Examiner*—Daniel E. Wyman
*Assistant Examiner*—Mrs. Y. Harris-Smith
*Attorney, Agent, or Firm*—James W. Adams, Jr.; William H. Pitman

[57] ABSTRACT

Novel compositions, useful as additives for normally liquid fuels to impart dispersancy, anti-icing and rust inhibiting properties thereto, comprise salts of amines prepared by the Mannich reaction between a hydroxy-substituted aromatic compound, usually an alkylphenol in which the alkyl group contains at least about six carbon atoms; formaldehyde or a reversible polymer thereof; and a hydroxyalkyl-substituted amine such as diethanolamine. The acid portion of the salt is preferably derived from a carboxylic acid containing about 14–24 carbon atoms especially an aliphatic radical-substituted succinic acid or an acidic ester thereof. Epoxide adducts of such salts are useful for the same purposes.

36 Claims, No Drawings

SALTS OF MANNICH BASES AND DERIVATIVES THEREOF

This application is a continuation-in-part of copending application Ser. No. 413,480, filed Nov. 7, 1973, now abandoned.

This invention relates to new compositions of matter useful as additives for normally liquid fuels. More particularly, it relates to (1) compounds of the formula

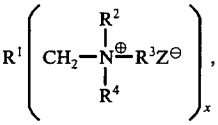

, wherein:

$R^1$ is a hydroxy-substituted aromatic radical, or a hydroxy-substituted aromatic radical which contains as a further substituent an aliphatic-based radical;

$R^2$ is a hydroxy-substituted lower alkyl radical or

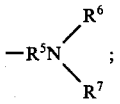

;

each of $R^3$ and $R^7$ is hydrogen or a lower alkyl or hydroxy-substituted lower alkyl radical;

$R^4$ is hydrogen or a lower alkyl radical;

$R^5$ is a lower alkylene radical;

$R^6$ is a hydroxy-substituted lower alkyl radical;

Z is one equivalent of an anion; and $x$ is the valence of $R^1$;

and to (2) epoxide adducts of such compounds.

The compounds of this invention are most conveniently prepared by neutralization of products of the Mannich reaction between at least one hydroxyaromatic compound, formaldehyde (or a reversible polymer thereof) and at least one hydroxyalkyl amine, as more particularly described hereinafter. Thus, the radical $R^1$ is derived (by removal of hydrogen from the aromatic nucleus) from the hydroxyaromatic compound, of which examples are phenol, catechol, resorcinol, $\alpha$-naphthol and $\beta$-naphthol.

The hydroxyaromatic compound usually contains at least one aliphatic radical as a substituent. As used herein, the term "aliphatic" denotes a radical having a carbon atom directly attached to the remainder of the molecule and having predominantly aliphatic hydrocarbon character within the context of this invention. Such radicals include the following:

1. Aliphatic hydrocarbon radicals, which may be alkyl (i.e., saturated) or alkenyl but which are usually saturated or substantially saturated.

2. Substituted aliphatic radicals; that is, aliphatic radicals containing non-hydrocarbon substituents which, in the context of this invention, do not alter the predominantly aliphatic hydrocarbon character thereof. Those skilled in the art will be aware of suitable substituents; examples are

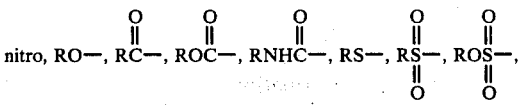

-continued

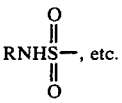

(R being a hydrocarbon radical and usually a lower alkyl radical, the word "lower" whenever used herein meaning seven carbon atoms or less).

3. Hetero radicals; that is, radicals which, while having predominantly aliphatic hydrocarbon character within the context of this invention, contain atoms other than carbon present in a chain otherwise composed of carbon atoms. Suitable hetero atoms will be apparent to those skilled in the art and include, for example, oxygen, nitrogen and sulfur.

In general, no more than about three substituents or hetero atoms, and preferably no more than one, will be present for each 10 carbon atoms in the aliphatic radical.

The preferred hydroxyaromatic compounds are alkylaromatic ones, especially monoalkylaromatic ones in which the alkyl group contains at least about six and most often up to about 100 carbon atoms, and in which the aromatic radical is mononuclear and monohydroxy-substituted (e.g., alkyl phenols). Especially preferred are alkyl phenols in which the alkyl group contains about 10–20 carbon atoms. The integer $x$ is usually 1 or 2 (though it may be as large as the number of aromatic carbon atoms not otherwise substituted) and is preferably 1; that is, the preferred additive compounds are salts of mono-(Mannich bases) of the hydroxyaromatic compounds previously described.

In the compounds of this invention, each of $R^2$ and $R^3$ is usually a hydroxy-substituted lower alkyl radical and preferably a hydroxyethyl radical. Any valences of the nitrogen atom which are not satisfied by such radicals are satisfied by hydrogen or lower alkyl. The compounds of this invention may be ordinary amine salts ($R^4$ is hydrogen) or quaternary ammonium salts ($R^4$ is lower alkyl, usually methyl).

Also contemplated as part of this invention are compounds in which $R^2$ is

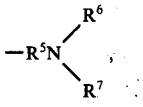

wherein $R^5$ is a straight or branched chain lower alkylene (usually an ethylene) radical; $R^6$ is a hydroxy-substituted lower alkyl radical and is usually a hydroxyethyl radical, and $R^7$ is hydrogen or a lower alkyl or (preferably) hydroxy-substituted lower alkyl radical and is usually a hydroxyethyl radical. Compounds of this type are derived from the hydroxyalkyl-substituted alkylene diamines such as 2-(2-aminoethylamino)ethanol and 2-(2-aminopropylamino)ethanol.

The anion Z may be any anion such as chloride, nitrate, sulfate, acetate, stearate, or the like. Usually, however, it is derived from a mono- or polybasic carboxylic acid containing at least about 10 and usually up to about 100 carbon atoms, preferably about 14–24 carbon atoms, or from an acidic amide, amine salt or ester derived from such acid. Examples of the latter group of compounds include the monoesters of succinic acids containing aliphatic or substituted aliphatic radicals with about 10–20 carbon atoms, as well as the monoamides and mono-(amine salts) of such acids.

The Mannich bases which are converted to the compounds of this invention are, as previously noted, conveniently prepared by the Mannich reaction between a suitable hydroxyaromatic compound or the like, formaldehyde or a reversible polymer thereof (e.g., paraformaldehyde, trioxane), and an amine of the formula

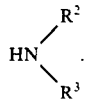

The reaction may be effected at a temperature between room temperature and about 225° C., usually about 50°–200° C., with the amounts of the reagents generally being such as to provide a mole ratio of hydroxyaromatic compound to formaldehyde to amine ranging from about 1:1:1 to about 1:3:3. It is frequently convenient to use a substantially inert liquid diluent, such as an aliphatic or aromatic hydrocarbon (e.g., petroleum fractions, toluene, xylene), to facilitate the reaction. Suitable methods for preparation of the Mannich bases are described in U.S. Pat. Nos. 2,033,092 and 3,297,597, the disclosures of which are incorporated by reference herein.

The compounds of this invention may, as previously mentioned, be either ordinary amine salts or quaternary salts. The former are ordinarily prepared by neutralization of the Mannich bases themselves with suitable acids, and the latter by quaternization of the amines by conventional methods with such reagents as methyl or ethyl iodide.

Also contemplated as part of this invention are adducts of an epoxide with one or more salts of Mannich bases as described above. Such adducts frequently impart demulsification properties to fuels, in addition to the properties described hereinafter, when used as additives therein.

The epoxide used for preparing the adduct may be, for example, ethylene oxide, propylene oxide, glycidyl ethers, butyl epoxystearate or an epoxide prepared from a commercially available $\alpha$-olefin mixture in which the olefins contain about 11–14 carbon atoms. Lower alkylene oxides, especially ethylene and propylene oxide, are preferred.

The epoxide adducts can be obtained in two ways. The first comprises merely mixing the epoxide with the salt, up to about 20 moles of epoxide being used per mole of salt, and maintaining at a suitable temperature (usually about 25°–125° C.) for a period of time sufficient to enable the reaction to take place. The second comprises first preparing the epoxide adduct of the Mannich base (using the proportions and conditions described above) and subsequently forming a salt thereof.

Typical compounds of this invention, and methods for their preparation, are illustrated in the following examples. All parts are by weight.

EXAMPLE 1

A solution of 798 parts (3 moles) of an alkyl phenol obtained by alkylation of phenol with tetrapropene in 900 parts of xylene is heated to 100° C., and 462 parts (4.5 moles) of diethanolamine is added. The mixture is further heated to 120° C. and 198 parts (6 moles) of paraformaldehyde is added slowly so as to minimize foaming. After paraformaldehyde addition is complete, the mixture is heated to 140° C. for 10 hours while water is removed by distillation. It is then filtered to yield a 40% solution in xylene of the desired Mannich base. A salt of the Mannich base is prepared by mixing 67 parts of said solution with 33 parts of an acidic ester prepared from one mole of tetrapropene-substituted succinic anhydride and about 0.45 mole of propylene glycol.

EXAMPLE 2

A salt of the Mannich base of Example 1 is prepared by mixing approximately 36 parts of the solution of said Mannich base, 44 parts of a 75% solution in mineral oil of a polyisobutenyl succinic acid in which the substituent has a molecular weight of about 1000, and 20 parts of xylene.

EXAMPLE 3

A solution of 798 parts (3 moles) of an alkyl phenol similar to that of Example 1 in 989 parts of xylene is heated to 100° C., and 598 parts (4.5 moles) of diisopropanolamine is added. The mixture is heated to 120° C. and 198 parts (6 moles) of paraformaldehyde is added slowly. The temperature is raised to 210° C. and held there for eight hours with removal of water by distillation. Upon filtration, there is obtained a 60% solution in xylene of the desired product. A salt thereof is prepared as described in Example 1.

EXAMPLE 4

To a solution of 798 parts (3 moles) of an alkyl phenol similar to that of Example 1 in 900 parts of xylene at 100° C., is added 468 parts (4.5 moles) of 2-(2-aminoethylamino)-ethanol. The mixture is heated to 120° C. and 198 parts (6 moles) of paraformaldehyde is added slowly. After evolution of water is complete, the mixture is cooled and sufficient xylene is added to provide a 60% solution (after filtration) of the Mannich base therein. A salt thereof is prepared as described in Example 1.

EXAMPLE 5

A solution of 1257 parts (3 moles) of an alkyl phenol obtained by alkylation of phenol with polyisobutene having a molecular weight of about 300 in 1321 parts of xylene is heated to 90° C., and 630 parts (6 moles) of diethanolamine is added followed by 198 parts (6 moles) of paraformaldehyde (added slowly to minimize foaming). The mixture is heated to 145° C. for 9 hours as water is removed by distillation, and is then filtered to yield a 60% solution in xylene of the desired Mannich base. A salt thereof is prepared as described in Example 2.

EXAMPLE 6

A solution of 625 parts (0.5 mole) of an alkyl phenol obtained by alkylation of phenol with polyisobutene having a molecular weight of about 1000 in 489 parts of mineral oil is heated to 120° C., and 25 parts (0.75 mole) of paraformaldehyde is added slowly. The mixture is heated to 160° C. for 4 hours as water is removed by distillation, and is then cooled to 90° C. and 79 parts (0.75 mole) of diethanolamine is added. The temperature is raised to 120° C. and an additional 33 parts (1 mole) of paraformaldehyde is added. The temperature is raised to 160° C. and maintained there for six hours as water is removed by distillation. The mixture is then filtered to yield a a 60% solution in mineral oil of the desired Mannich base. A salt thereof is prepared as described in Example 1.

EXAMPLE 7

A solution of 910 parts (4.74 moles) of heptylphenol in 1358 parts of xylene is heated to 80° C., and 997 parts (9.48 moles) of diethanolamine is added. The mixture is heated to 110° C. and 313 parts (9.48 moles) of paraformaldehyde is added slowly. The mixture is then heated to 140° C. as water is removed by azeotropic distillation. The residue is cooled and filtered to yield the desired product as a 60% solution in xylene. A salt thereof is prepared as described in Example 2.

The compounds of this invention are useful as additives for fuels, in which they function as dispersants, anti-icers and rust inhibitors. The fuels in which said compounds are used are normally liquid fuels, usually hydrocarbonaceous petroleum distillate fuels such as motor gasoline as defined by ASTM Specification No. D-439-73 and diesel fuel or fuel oil as defined by ASTM Specification D-396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also useful as are liquid fuels derived from vegetable or mineral sources such as corn, alfalfa, shale and coal. Normally liquid fuels which are mixtures of one or more hydrocarbonaceous fuels and one or more non-hydrocarbonaceous materials also contemplated. Examples of such mixtures are combinations of gasoline and ethanol, diesel fuel and ether, and the like. Particularly preferred is gasoline, that is, a mixture of hydrocarbons having an ASTM boiling point of about 60° C. at the 10% distillation point to about 205° C. at the 90% distillation point.

Generally, these fuel compositions contain an amount of the compound of this invention sufficient to disperse solids, inhibit icing and inhibit rust formation therein; usually this amount is about 1–10,000, preferably 4–1000 parts by weight of said compound per million parts by weight of fuel. The compound of this invention will usually be dissolved in the fuel but may be stably dispersed therein, e.g., as a sol or the like.

The fuel composition can contain, in addition to the compound of this invention, other additives which are well known to those of skill in the art. These can include anti-knock agents such as tetra-alkyl lead compounds, lead scavengers such as halo-alkanes (e.g., ethylene dichloride and ethylene dibromide), deposit preventers or modifiers such as triaryl phosphates, dyes, cetane improvers, antioxidants such as 2,6-di-tertiary-butyl-4-methylphenol, auxiliary rust inhibitors such as alkylated succinic acids and anhydrides, bacteriostatic agents, gum inhibitors, metal deactivators, demulsifiers, dehazers, upper cylinder lubricants, auxiliary anti-icing agents and the like.

The compound of this invention can be added directly to the fuel or it can be diluted with a substantially inert, normally liquid organic diluent such as mineral oil, xylene, or a normally liquid fuel as described above, to form an additive concentrate which is then added to the fuel in sufficient amounts to form the fuel composition. These concentrates generally contain about 20–90% by weight of the compound of this invention and can contain in addition any of the above-described conventional additives. The remainder of the concentrate is the diluent.

Typical fuel compositions containing the compounds of this invention comprise gasoline (which may be leaded or unleaded) containing additives as listed in the following table, all parts being by weight per million parts of the final composition.

| Ingredient | Parts Per Million A | B | C |
|---|---|---|---|
| Product of Example 1 | 160.0 | — | — |
| Product of Example 2 | — | 30.7 | 3.7 |
| Reaction product of polyisobutenyl (mol. wt. about 1000) succinic anhydride with polyethylene polyamine mixture | — | 88.1 | 33.6 |
| Ethoxylated reaction product of oleic-naphthenic acid mixture with polyethylene polyamine mixture | — | 3.0 | 1.1 |
| Tretolite proprietary demulsifier composition | — | 5.9 | 4.2 |
| Exxon proprietary demulsifier composition | — | 5.9 | — |
| Nalco proprietary dehazer composition | — | 8.8 | — |
| Isohexyl alcohol | — | — | 30.0 |
| Isooctyl alcohol | — | 103.1 | — |
| Xylene | — | 114.5 | 27.4 |

What is claimed is:

1. A composition selected from the group consisting of (1) compounds of the formula

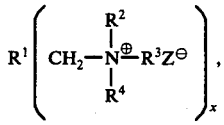

, wherein:

$R^1$ is a hydroxy-substituted aromatic radical, or a hydroxy-substituted aromatic radical which contains as a further substituent an aliphatic radical;

$R^2$ is a hydroxy-substituted lower alkyl radical or

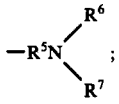

;

each of $R^3$ and $R^7$ is hydrogen or a lower alkyl or hydroxy-substituted lower alkyl radical;

$R^4$ is hydrogen or a lower alkyl radical;

$R^5$ is a lower alkylene radical;

$R^6$ is a hydroxy-substituted lower alkyl radical;

Z is one equivalent of an anion; and $x$ is the valence of $R^1$;

and (2) epoxide adducts of such compounds.

2. A composition according to claim 1 comprising compound (1).

3. A compound according to claim 2 wherein Z is an anion derived from a mono- or polybasic carboxylic acid containing at least about 10 carbon atoms.

4. A compound according to claim 3 wherein $R^1$ is a monohydroxy-substituted monoalkylaromatic radical in which the alkyl group contains at least about 6 carbon atoms.

5. A compound according to claim 4 wherein the alkyl group in $R^1$ contains about 10–20 carbon atoms, each of $R^2$ and $R^3$ is a hydroxyethyl radical, $R^4$ is hydrogen, and Z is an anion derived from a succinic acid containing an aliphatic radical with about 10–20 carbon atoms.

6. A compound according to claim 5 wherein the acid from which the Z radical is derived is an acidic ester.

7. A compound according to claim 6 wherein $x$ is 1 or 2.

8. A compound according to claim 7 wherein the alkyl group in $R^1$ and the aliphatic radical in Z are tetrapropenyl groups.

9. A composition according to claim 1 comprising epoxide adduct (2).

10. An adduct according to claim 9 wherein the epoxide is a lower alkylene oxide and Z is an anion derived from a mono- or polybasic carboxylic acid containing at least about 10 carbon atoms.

11. An adduct according to claim 10 wherein the epoxide is ethylene or propylene oxide, $R^1$ is a monohydroxy-substituted monoalkylaromatic radical in which the alkyl group contains about 10–20 carbon atoms, each of $R^2$ and $R^3$ is a hydroxyethyl radical, $R^4$ is hydrogen, Z is an anion derived from an acidic ester of a succinic acid containing an aliphatic radical with about 10–20 carbon atoms, and $x$ is 1 or 2.

12. An adduct according to claim 11 wherein the epoxide is propylene oxide, the alkyl group in $R^1$ and the aliphatic radical in Z are tetrapropenyl groups, and $x$ is 1 or 2.

13. A composition comprising a major amount of a normally liquid fuel and, dissolved or substantially stably dispersed therein, a minor amount sufficient to improve dispersancy, anti-icing or rust inhibiting properties thereof of a composition according to claim 1.

14. A composition comprising a major amount of a normally liquid fuel and, dissolved or substantially stably dispersed therein, a minor amount sufficient to improve dispersancy, anti-icing or rust inhibiting properties thereof of a composition according to claim 2.

15. A composition comprising a major amount of a normally liquid fuel and, dissolved or substantially stably dispersed therein, a minor amount sufficient to improve dispersancy, anti-icing or rust inhibiting properties thereof of a compound according to claim 3.

16. A composition comprising a major amount of a normally liquid fuel and, dissolved or substantially stably dispersed therein, a minor amount sufficient to improve dispersancy, anti-icing or rust inhibiting properties thereof of a compound according to claim 4.

17. A composition comprising a major amount of a normally liquid fuel and, dissolved or substantially stably dispersed therein, a minor amount sufficient to improve dispersancy, anti-icing or rust inhibiting properties thereof of a compound according to claim 5.

18. A composition comprising a major amount of a normally liquid fuel and, dissolved or substantially stably dispersed therein, a minor amount sufficient to improve dispersancy, anti-icing or rust inhibiting properties thereof of a compound according to claim 6.

19. A composition comprising a major amount of a normally liquid fuel and, dissolved or substantially stably dispersed therein, a minor amount sufficient to improve dispersancy, anti-icing or rust inhibiting properties thereof of a compound according to claim 7.

20. A composition comprising a major amount of a normally liquid fuel and, dissolved or substantially stably dispersed therein, a minor amount sufficient to improve dispersancy, anti-icing or rust inhibiting properties thereof of a compound according to claim 8.

21. A composition comprising a major amount of a normally liquid fuel and, dissolved or substantially stably dispersed therein, a minor amount sufficient to improve dispersancy, anti-icing or rust inhibiting properties thereof of a composition according to claim 9.

22. A composition comprising a major amount of a normally liquid fuel and, dissolved or substantially stably dispersed therein, a minor amount sufficient to improve dispersancy, anti-icing or rust inhibiting properties thereof of an adduct according to claim 10.

23. A composition comprising a major amount of a normally liquid fuel and, dissolved or substantially stably dispersed therein, a minor amount sufficient to improve dispersancy, anti-icing or rust inhibiting properties thereof of an adduct according to claim 11.

24. A composition comprising a major amount of a normally liquid fuel and, dissolved or substantially stably dispersed therein, a minor amount sufficient to improve dispersancy, anti-icing or rust inhibiting properties thereof of an adduct according to claim 12.

25. A composition comprising gasoline and about 4–1000 parts by weight, per million parts of said gasoline, of a composition according to claim 1.

26. A composition comprising gasoline and about 4–1000 parts by weight, per million parts of said gasoline, of a composition according to claim 2.

27. A composition comprising gasoline and about 4–1000 parts by weight, per million parts of said gasoline, of a compound according to claim 3.

28. A composition comprising gasoline and about 4–1000 parts by weight, per million parts of said gasoline, of a compound according to claim 4.

29. A composition comprising gasoline and about 4–1000 parts by weight, per million parts of said gasoline, of a compound according to claim 5.

30. A composition comprising gasoline and about 4–1000 parts by weight, per million parts of said gasoline, of a compound according to claim 6.

31. A composition comprising gasoline and about 4–1000 parts by weight, per million parts of said gasoline, of a compound according to claim 7.

32. A composition comprising gasoline and about 4–1000 parts by weight, per million parts of said gasoline, of a compound according to claim 8.

33. A composition comprising gasoline and about 4–1000 parts by weight, per million parts of said gasoline, of a composition according to claim 9.

34. A composition comprising gasoline and about 4–1000 parts by weight, per million parts of said gasoline, of an adduct according to claim 10.

35. A composition comprising gasoline and about 4–1000 parts by weight, per million parts of said gasoline, of an adduct according to claim 11.

36. A composition comprising gasoline and about 4–1000 parts by weight, per million parts of said gasoline, of an adduct according to claim 12.

* * * * *